United States Patent [19]

Stinson

[11] Patent Number: 4,805,584

[45] Date of Patent: Feb. 21, 1989

[54] LIGHWEIGHT COLLAPSIBLE ARCHERY QUIVER

[76] Inventor: Robert E. Stinson, 7292 Peaceful Valley Rd., Acme, Mich. 49610

[21] Appl. No.: 925,558

[22] Filed: Oct. 31, 1986

[51] Int. Cl.[4] ..... F41B 5/00; F41D 10/00

[52] U.S. Cl. ..... 124/86; 224/916; 124/24 A

[58] Field of Search ..... 124/23 R, 24 R, 41 R, 124/41 A, 41 B, 45, 86, 23 A, 24 A, 86, 88; 224/916

[56] References Cited

U.S. PATENT DOCUMENTS

| | | | |
|---|---|---|---|
| 2,997,999 | 8/1961 | Crowder | 124/88 |
| 3,595,214 | 7/1971 | O'Malley | 124/88 |
| 3,716,174 | 2/1973 | Ehlert | 124/41 R |
| 3,946,718 | 3/1976 | Garman | 124/86 |
| 4,156,496 | 5/1979 | Stinson | 124/23 A |
| 4,195,616 | 4/1980 | Darlington | 124/24 A |
| 4,363,312 | 12/1982 | Spitzke | 124/88 |
| 4,621,606 | 11/1986 | Toth | 124/24 A |

*Primary Examiner*—Richard C. Pinkham
*Assistant Examiner*—Mark S. Graham
*Attorney, Agent, or Firm*—Price, Heneveld, Cooper, DeWitt & Litton

[57] ABSTRACT

A small, compact and lightweight bow-mounted arrow quiver for hunters and the like, having a small broadhead shield of a size and shape which may receive only a single broadhead arrow tip, and having an arrow shaft holder similarly adapted to receive only a single arrow shaft, both the broadhead shield and the arrow shaft holder being supported on a lightweight, elongated support means. Preferably, such support means is collapsible in nature, comprising a pair of pivotally-connected members which may alternatively be tightened into axially-aligned disposition when the quiver is in use, or otherwise released from such aligned disposition and pivoted upon one another to form a small and compact structure which may readily be carried in the pocket of the user.

4 Claims, 3 Drawing Sheets

LIGHWEIGHT COLLAPSIBLE ARCHERY QUIVER

TECHNICAL FIELD

This invention relates to archery equipment, and more particularly to bow-mounted arrow-holding apparatus, i.e., quivers; more particularly still, the invention relates to special-purpose, compact and lightweight, bow-mounted quivers intended, for example, as for particular hunting applications and the like.

BACKGROUND

The evolution of archery quivers has occurred over a span of many years, and has seen the advent of many different versions and styles of arrow-holding devices. Generally speaking, however, the development has progressed from the ancient, classical type of device, comprising a sheath-like apparatus which was slung from or strapped to the body, usually over the shoulder and across the back of the archer, and which loosely contained a number of arrows, to the modern form of bow-mounted quiver which holds a lesser number of arrows (e.g., four to six) and retains them in mutually-spaced and individually-secured arrangement, permitting separate withdrawal of individual arrows as needed, but otherwise carrying the arrows upon the bow, in mounted and covered condition. At the same time, there are also other types of "modern" arrow quivers, e.g., back quivers, as well as belt-mount quivers and the like, most of which have the attributes of independent multiple-arrow retention but are otherwise particularly designed for particular applications or circumstances.

Generally speaking, all such known "modern" types of arrow quivers have attendant well-known attributes which involve certain limitations. For example, such quivers usually involve a trade-off between providing immediate and rapid arrow access for a fast second shot (as for example by hunters who have missed the first shot and who have only a very limited time in which to shoot again) and the desirable circumstance of having the bow unencumbered by bow-mounted apparatus. That is, bow-mounted quivers provide the highly desirable feature of close access to additional arrows, making it possible to withdraw a second arrow very quickly and with only the most limited arm and body motion, but this type of quiver does significantly encumber the bow and inevitably makes aiming and shooting more awkward, and probably slower, than is true without such apparatus.

Accordingly, bow hunters have developed preferences and habits over the years. Typically, such hunters use bow-mounted quivers as a general matter, but they remove such quivers from the bow whenever and wherever that is possible. For example, bow hunters often hunt from tree stands or other elevated stations or blinds, etc., and it has become standard practice for hunters to remove the typical bow-mounted quiver from the bow once the hunter has gained the desired position in his stand and actually commences hunting. Upon such removal, the hunter typically attempts to secure the detached bow quiver upon some portion of the hunting blind or stand, in some manner which will make additional arrows reasonably available to the hunter if needed, but leaving the bow unobscured. Of course, any such arrangement as this does not provide the desired rapid and limited-motion second-arrow availability which is really desired.

THE PRESENT INVENTION

In accordance with the present invention, a new and desirable form of small, lightweight and collapsible bow-mount quiver is provided which operates to resolve the aforementioned dichotomy between shooting convenience and arrow availability. This is accomplished by, in effect, providing a new type of quiver, which provides a new function in the customary scheme of hunting, as that has become known in the past.

More particularly, in accordance with the present invention, a small, lightweight, and collapsible quiver is provided which is intended to hold only a very limited number of arrows, i.e., in a preferred embodiment only a single such arrow. Additionally, the new form of quiver apparatus is made to be bow-mounted for its intended use, but is also made to be readily demountable from the bow and, due to its small, lightweight, and collapsible nature; thus, the new type of quiver provided by the present invention may be very conveniently stowed out of the way in a pocket, etc., so as to impose substantially no obstacle or burden upon the archer.

Accordingly, the present invention provides a collapsible, readily-carried device of small physical size and very little weight which may conveniently be carried on the person of the hunter until he has arrived at his desired hunting station, whereupon the device may easily and quickly be assembled into operative configuration and mounted upon the bow, where it functions to maintain one (or other such small number) hunting arrow immediately available for rapid subsequent use, substantially without imposing any obstacle or inconvenience upon the hunter which tends to adversely affect the shooting of a primary arrow held ready for action (e.g., knocked upon the bow string, etc.).

Further, the new and useful quiver device of the present invention is preferably made to be interchangeably mountable with standard types of bow-mount quivers, such that a conventional multiple-arrow bow-mount quiver may be carried upon the bow in the usual manner while the hunter travels and/or climbs to his hunting station (stand or blind), whereupon the larger, bulky, and obtrusive standard quiver may be detached from the bow and the small, compact, collapsible device of the invention mounted in its place upon the bow, to receive a single arrow from the conventional bow-mount quiver, whereupon the latter may then simply be rested or stowed anywhere at the hunting stand without the requirement that it be immediately available for hunting use. Similarly, the novel collapsible quiver of the invention may be used in conjunction with known types of back quivers, in the same general manner, thus making available the advantages of a bow-mount quiver without the inconvenience and disadvantages of known types of such devices.

The foregoing and other features, structure and operation of the apparatus in accordance with the invention will become more apparent upon consideration of the ensuing specification, particularly when taken in conjunction with the appended drawings setting forth a preferred embodiment of the invention.

DESCRIPTION OF THE PREFERRED EMBODIMENTS

Figure 1:
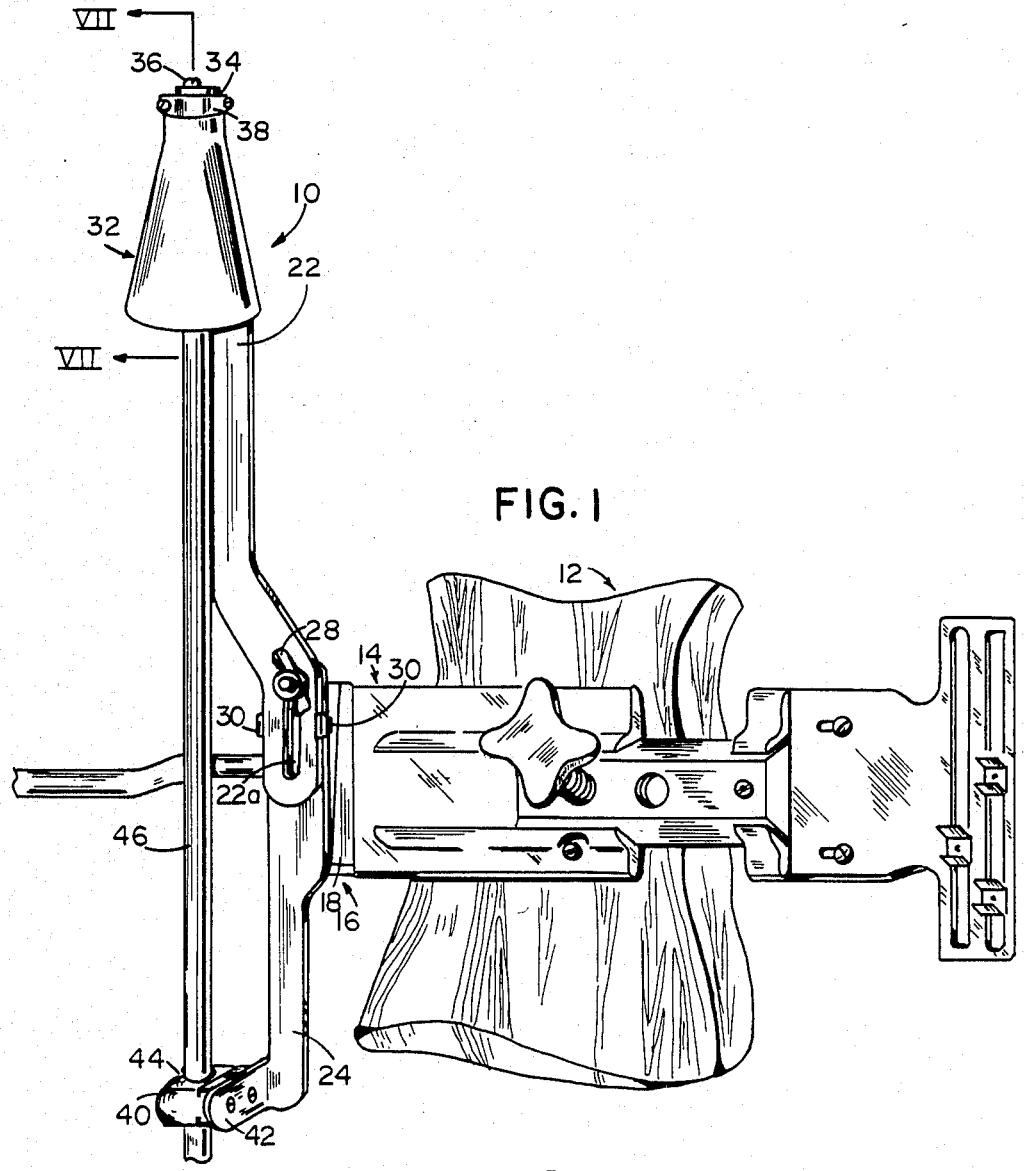
FIG. 1 is a fragmentary, front perspective view of a collapsible quiver apparatus in accordance with the invention, shown mounted upon a typical bow by use of certain novel apparatus which is the subject of another invention by the applicant, identified more fully hereinafter.

Referring now in more detail to the drawings, the novel lightweight, collapsible quiver apparatus 10 of the invention is shown in FIG. 1 operably mounted upon a typical archery bow 12, which may for purposes of illustration be deemed to represent any conventional bow. In FIG. 1, the quiver apparatus 10 is mounted upon the bow 12 by use of a novel cable guard and mounting apparatus 14, which is shown for purposes of general illustration only and forms no direct part of the present invention. For a particular disclosure of such cable guard and mounting apparatus, reference is made to Applicant's co-pending application Ser. No. 853,678, filed Apr. 18, 1986 (now issued as U.S. Pat. No. 4,704,800), which is incorporated herein by reference.

Figure 2:
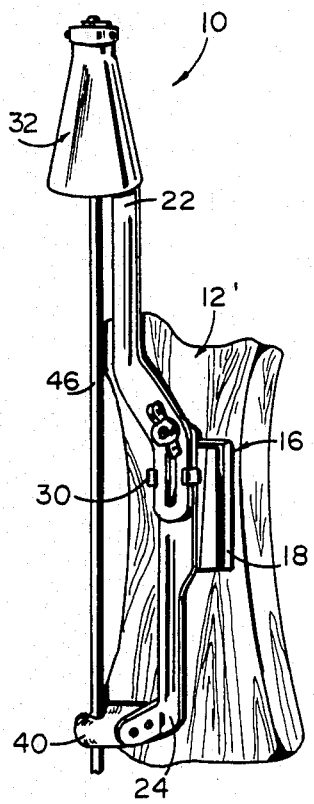
FIG. 2 is a fragmentary perspective view similar to FIG. 1 but showing the quiver apparatus of the invention mounted upon a bow in another manner.

As shown in FIG. 2, the novel quiver apparatus 10 is mounted upon a different bow 12' in an operative position, in this instance without use of the cable guard and mounting apparatus 14 shown in FIG. 1. As will be seen in FIG. 2, the quiver 10 is mounted directly in alignment with, and upon, the handle portion of the bow 12', in the conventional position for bow-mounted quivers generally. It is to be noted, however, that the quiver apparatus 10 is preferably mounted upon both the bow 12 and the bow 12' by use of a quick-disconnect mounting apparatus 16 of the same type as that shown in Applicant's prior U.S. Pat. No. 4,156,496, since a very desirable degree of cooperation and operational facility is gained thereby. Generally speaking, such a mounting apparatus includes a base or support member 18 which is directly secured to the bow (or to the mounting apparatus 14, where that is used) in a generally permanent manner, together with an interfitting slide connector 20 (FIGS. 3 and 4), which is slidably receivable by the base member 18, as by a tongue-and-groove connection defined by such two components to provide a secure but quickly-detachable mounting connection therebetween.

As illustrated in the various figures, the quiver apparatus 10 includes a pair of support arms 22 and 24 which are pivotally connected together by a threaded stud or bolt 26 (FIGS. 3 and 4) which receives a cooperatively engaged wing nut 28 or the like. More particularly, support arm 22 preferably includes an elongated slot **22*a* which fits slidably over the stud 26, and the latter is preferably press-fitted into or otherwise secured to support arm 24. This arrangement provides a pivot connection between the two support arms and also imparts adjustability to the structure, different such positions of relative adjustment being maintainable by tightening the wing nut 28 down upon stud 26 to effectively clamp support arms 22 and 24 against one another. Preferably, the lower support arm 24 includes a pair of mutually-spaced, upstanding lugs 30 which are spaced apart so as to slidably receive the lower portion of support arm 22** between them, to thereby reinforce the longitudinal stability of the assembly once the support arms are placed in the desired position of relative adjustment.

Figure 7:
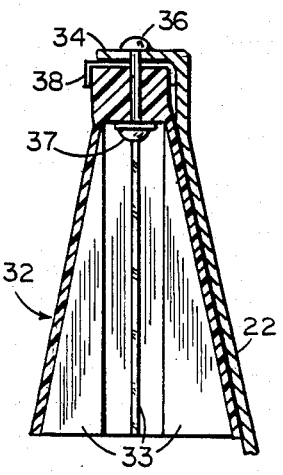
FIG. 7 is an enlarged sectional side elevation taken along the plane VII—VII of FIG. 1.
Figure 3:
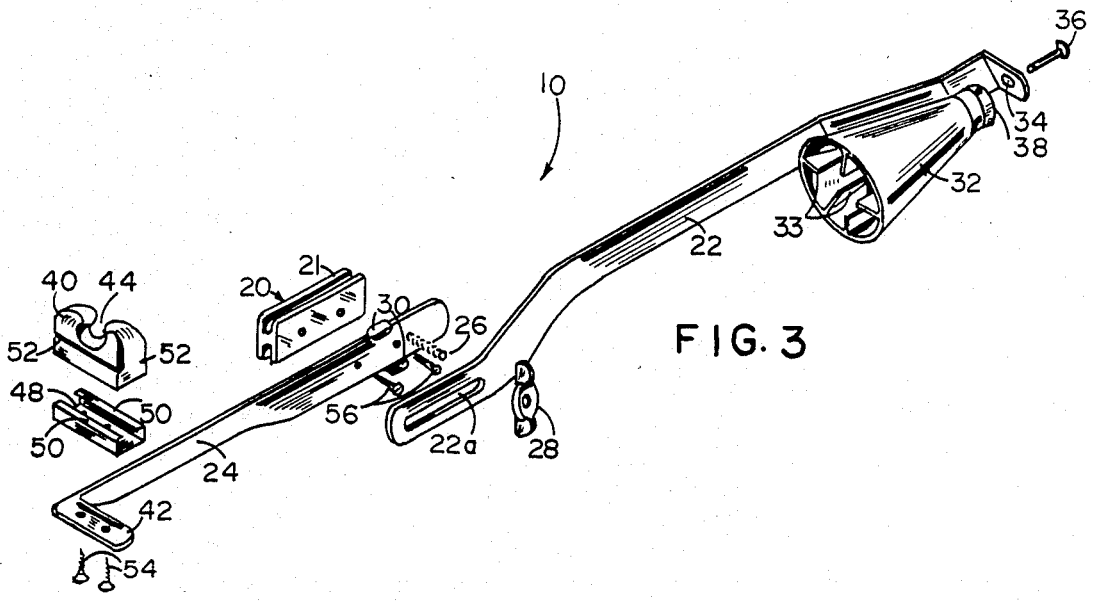
FIG. 3 is an exploded perspective view of the quiver apparatus alone.
Figure 4:
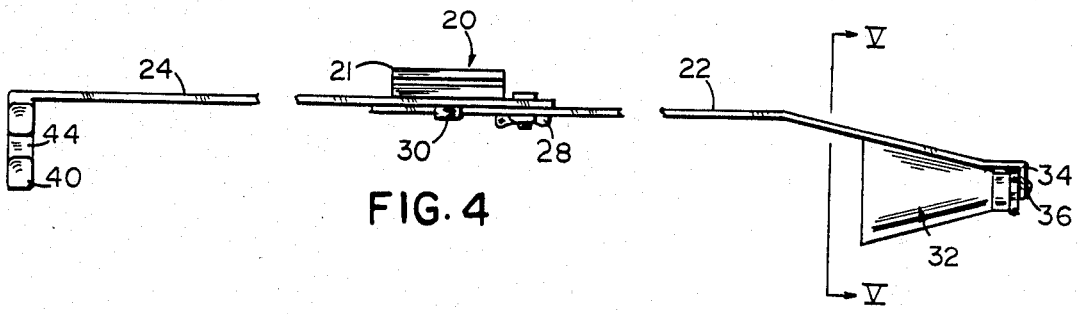
FIG. 4 is a side elevational view of the quiver apparatus shown in FIG. 3.

At its uppermost end, the top support arm 22 carries a broadhead shield 32, which in the most preferred embodiment comprises a single cup-like, generally conical dome of a size to encompass a single broadhead hunting arrow tip. As best illustrated in FIGS. 3, 4 and 7, the upward end extremity 34 of top support arm 22 may be laterally offset at right angles to provide a support base for the broadhead shield 32, the two such components being securely connected together by suitable mechanical fastening means such as a screw or rivet 36 extending into an appropriate aperture in the upper end portion of the broadhead shield 32. In the form illustrated, a cup-like reinforcement collar 38 is disposed upon the top portion of the broadhead shield 32 in order to structurally reinforce it at its point of connection to the offset portion 34.

At the lower extremity of quiver 10, support arm 24 carries a resilient, rubber-like arrow holder 40, which is supported upon a laterally-offset flange portion 42 which is preferably integral with support arm 24. As will be understood by those skilled in the art, arrow holder 40 has a hooded recess 44 formed therein of a size to frictionally receive the shaft of an arrow 46 when the same is pushed into place in a manner momentarily flexing open the hooded recess 44, following which the inherent resiliency of the flexible arrow holder serves to grip the shaft of arrow 46 and hold the same in place.

In the preferred embodiment illustrated, arrow holder 40 is mounted upon the offset flange portion 42 at the base of support arm 24 by use of a mounting member 48 (FIG. 3) of generally U-shaped cross section which preferably has a pair of opposed edges 50 that are receivable within corresponding grooves 52 in the arrow holder 40. A pair of mechanical fasteners 54 (e.g., screws) extend through spaced recesses in flange portion 42 and are receivable within corresponding apertures in the mounting member 48, to thereby secure the arrow holder 40 in place upon flange 42. Preferably, the tips of the screws 54 extend into the resilient arrow holder 40 a brief distance to preclude inadvertent sliding detachment thereof from the mounting member 48.

Figure 5:
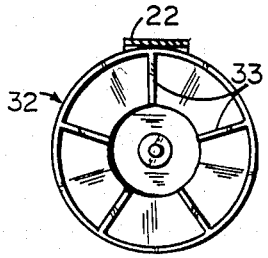
FIG. 5 is an enlarged, sectional end elevation taken through the plane V—V of FIG. 4.

As best seen in FIGS. 3, 5 and 7, the broadhead shield 32 preferably includes a series of internal ribs or walls 33 whose purpose is to fit between the blades of the broadhead arrow tip and thereby help to hold the arrow in position while precluding excess movement or rattling of the tip portion of the arrow with respect to the quiver. Preferably, the internal walls 33 may be formed integrally with the broadhead shield 32 generally, as by molding the entire part from a desired polymeric material, a preferred example of which is a medium-soft vinyl, whose surface resiliency helps to provide desirable quieting effects. Where such softer forms of polymeric material are used, the aforementioned reinforcement collar 38 is particularly desirable, since it adds structural integrity by reinforcing the assembly, collar 38 being secured to the broadhead shield 32 in any desired manner such as adhesive (e.g., epoxy) and/or mechanical fasteners such as screws extending laterally into the broadhead shield through the edges of the collar. Of course, more rigid materials may also be used for the broadhead shield, and where rigid materials are so used they may be lined internally with soft polymeric material for added quieting (sound-deadening) qualities.

While the number and relative spacing of the internal ribs or walls 33 is to some extent optional, a preferred arrangement is illustrated, i.e., five equally-spaced ribs extending into the interior of broadhead shield 32 to an extent which defines an included space between the inner ends of the ribs which approximates, and slightly exceeds, the diameter of the typical center (axial) hub portion of the broadhead tip.

As previously noted, the quiver assembly 10 is preferably secured to the bow 12 or 12′ in a quick-detachable manner, as by the releasable mounting bracket 16 shown in Applicant's prior U.S. Pat. No. 4,156,496. As noted above, such a structure includes a mounting block or support member 18 (FIGS. 1 and 2) which defines a T-shaped groove (not shown) of a size to receive a complementary portion of a slide connector 20, comprising a pair of oppositely-extending side edges 21 (FIGS. 3 and 5). As will be understood, the slide connector 20 is secured in a substantially permanent manner to the top portion of lower support arm 24, as for example by a pair of screws 56 or the like. In this manner, the quiver assembly 10 is made to be quickly mountable upon, and dismountable from, the mounting block 18 secured to the bow, so that the quiver apparatus 10 may readily be removed from or mounted upon the bow, as and when desired.

Figure 6:
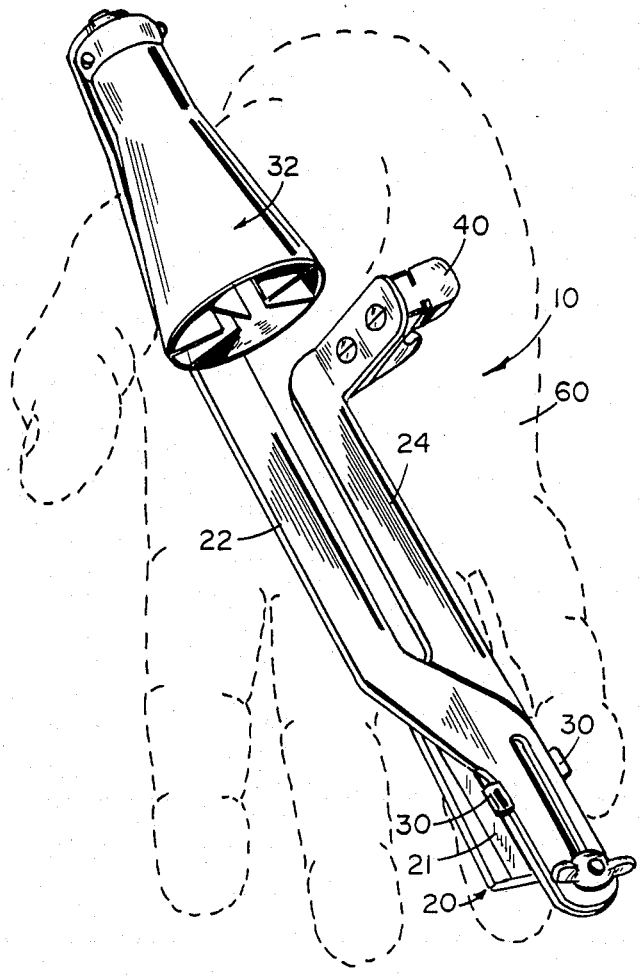
FIG. 6 is a front perspective view, partially in phantom, showing the novel quiver apparatus in a collapsed configuration and with size reference to the human hand.

The portability and compactness of the quiver apparatus 10 is illustrated by FIG. 6, in which the quiver apparatus is shown in its collapsed state and disposed for illustration in relation to an average-sized human hand 60, shown in phantom. From this, it will be seen that while the quiver apparatus 10 may be assembled into the elongated configuration shown in FIGS. 1 and 2 and adjusted lengthwise by means of the slot 22*a* to accommodate and readily hold the typical hunting arrow 46, the quiver apparatus 10 may nonetheless be readily detached from the bow and collapsed, by manipulation of the wing nut 28, such that the upper and lower support arms 22 and 24 are placed in general superposition with respect to one another, in which position the offset base portion 42 and arrow holder 40 lie generally beneath and alongside the broadhead shield 32. In this position, the support arms 22 and 24 are substantially reversed from that shown in FIGS. 1 and 2, but the upper support arm 22 nonetheless still fits within and between the positioning lugs 30, and the wing nut 28 may be tightened to hold the assembly in compact and secure relative position.

Due to its small and compact configuration in the collapsed position, the quiver apparatus may readily be seen to lend itself to storage in any convenient receptacle of small size, e.g., the hunter's pocket. Whether carried in that manner or upon the bow, it may be appreciated that the small size of the quiver apparatus in accordance herewith provides for a lightweight structure of compact size which provides substantially no burdening effect. Indeed, the quiver apparatus may readily be carried in the hand of the hunter as and when desired, since its lightweight and small size are such as to still permit limited use of the carrying hand.

From the foregoing disclosure, it will be seen that the present invention provides a novel form of archery quiver apparatus which is particularly beneficial to hunters under a variety of circumstances, thereby providing for utility and function of a nature not previously available to the hunter. Of course, it will be appreciated that the above detailed description is merely that of one exemplary preferred embodiment of the invention, and that numerous changes, alterations and variations may be made without departing from the underlying concepts and broader aspects of the invention as set forth in the appended claims, which are to be interpreted in accordance with the established principles of patent law, including the doctrine of equivalents.

The embodiments of the invention in which an exclusive property or privilege is claimed are defined as follows.

1. A compact, collapsible arrow quiver for hunters and other such sportsmen, comprising in combination: a pair of support arm members and means connecting such members to one another for movement between at least a pair of relative positions, a first such position having said support arm members extended generally lengthwise with respect to one another to form an elongated structure and a second such position having said arm members disposed generally adjacent one another to form a shortened structure; an arrowhead shield carried on one of said support members and an arrow shaft holder carried on the other such member; and a releasable mounting means connected to at least one of said support arm members, said mounting means being adapted to releasably mount said quiver upon an archery bow as well as upon any other support structures having a cooperative base for such mounting means, whereby said quiver may be conveniently carried upon the person of the hunter as well as mounted by said mounting means upon a bow or any of said other support structures having such a cooperative base.

2. The arrow quiver according to claim 1, wherein said support arm members are generally aligned lengthwise with one another along a common axis in said first position.

3. The arrow quiver according to claim 1, wherein said support arm members are positioned in generally parallel relation with one another in said second position.

4. The arrow quiver according to claim 3, wherein said means connecting said support arm members to one another for movement comprises a pivot connection therebetween.

* * * * *